US007787785B2

(12) United States Patent
Kidaka

(10) Patent No.: US 7,787,785 B2
(45) Date of Patent: Aug. 31, 2010

(54) IMAGE FORMING APPARATUS FOR DEVELOPING AN IMAGE BY A FIRST MODE OR A SECOND MODE BASED ON AN INPUT SIGNAL

(75) Inventor: Hiroyuki Kidaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 12/145,164

(22) Filed: Jun. 24, 2008

(65) Prior Publication Data

US 2009/0003870 A1 Jan. 1, 2009

(30) Foreign Application Priority Data

Jun. 26, 2007 (JP) ..... 2007-167460

(51) Int. Cl.
*G03G 15/00* (2006.01)
*G03G 15/02* (2006.01)

(52) U.S. Cl. ..... 399/38; 399/49; 399/50; 399/55; 399/81; 399/82

(58) Field of Classification Search ..... 399/38, 399/46, 49, 50, 51, 53, 55, 81, 82; 358/406, 358/504
See application file for complete search history.

(56) References Cited

U.S. PATENT DOCUMENTS

| | | | | |
|---|---|---|---|---|
| 5,339,137 | A * | 8/1994 | Kusumoto et al. | 399/50 |
| 2001/0036372 | A1* | 11/2001 | Regelsberger et al. | 399/55 |
| 2006/0110174 | A1* | 5/2006 | Ishida | 399/49 X |
| 2007/0047981 | A1* | 3/2007 | Ishida | 399/49 X |
| 2009/0080916 | A1* | 3/2009 | Ochiai | 399/81 X |

FOREIGN PATENT DOCUMENTS

| | | |
|---|---|---|
| JP | 61-151669 A | 7/1986 |
| JP | 6-102740 A | 4/1994 |

* cited by examiner

*Primary Examiner*—Sophia S Chen
(74) *Attorney, Agent, or Firm*—Canon USA Inc IP Division

(57) ABSTRACT

An image forming apparatus for forming an image with developing toner on an exposed portion has a mode in which a toner image is automatically output onto a recording material without using exposure by an exposure device. When an inclination adjustment of a corona charging device is performed using an output image on the recoding material, the image forming apparatus can output an image for adjusting the inclination of the charging device that is not affected by variation of an exposing light amount of the exposure device.

7 Claims, 11 Drawing Sheets

FIG. 6

| | ANALOG IMAGE | LIGHT AMOUNT DIFFERENCE (%) IN MAIN SCANNING DIRECTION OF OPTICAL SYSTEM FOR DIGITAL IMAGE | | |
|---|---|---|---|---|
| | – | 4 | 6 | 8 |
| POTENTIAL DIFFERENCE (V) BETWEEN FRONT END PORTION AND REAR END PORTION AFTER ADJUSTING DENSITY | LESS THAN 10 | 20~30 | 25~35 | 30~40 |

IMAGE FORMING APPARATUS FOR DEVELOPING AN IMAGE BY A FIRST MODE OR A SECOND MODE BASED ON AN INPUT SIGNAL

BACKGROUND OF THE INVENTION

1. Field of the Invention

The present invention relates to an image forming apparatus such as a copying machine and a laser beam printer using an electrophotographic method or an electrostatic recording method, more specifically, an image forming apparatus configured to detect an inclination of a charging device relative to a surface of an image carrier.

2. Description of the Related Art

In an image forming apparatus such as a copying machine configured to visualize a latent image formed on a photosensitive member and transfer the latent image to a transfer paper to form an image, surface potentials on a photosensitive drum in a main scanning direction becomes nonuniform due to variation of gaps (inclination of a charging device) between the charging device and the photosensitive drum in the main scanning direction. Therefore, fogging can be generated on, for example, a part of a front side or rear side of the transfer paper in the main scanning direction.

Conventionally, in order to address the aforementioned problem, for example, Japanese Patent Application Laid-Open No. 61-151669 discusses a technology which detects surface potentials on a photosensitive drum and adjusts an inclination angle of a charge wire to a surface of the photosensitive drum in an axis direction of the photosensitive drum based on the detected result to make the surface potentials on the photosensitive drum uniform.

However, a method which detects a plurality of surface potentials with respect to the axis direction of the drum to adjust the inclination, discussed in Japanese Patent Application Laid-Open No. 61-151669, requires a plurality of expensive potential sensors and results in increase of apparatus size or hinders cost reduction.

Japanese Patent Application Laid-Open No. 06-102740 discusses an analog image forming apparatus for copying a white reference original and forming an image of the reference original by irradiating with the original image. If image fogging is generated on an output image, the inclination of a charging device to a photosensitive drum is adjusted.

In other words, the image fogging is used as a toner image for adjusting the inclination of the charging device. However, in the method discussed in Japanese Patent Application Laid-Open No. 06-102740, a region where the toner image for adjustment is developed corresponds to a portion to be exposed by an exposure device.

Since density of the toner image on a recording material varies depending on variation of an exposing light amount from the exposure device, when the exposing light amount is not uniformly emitted from the exposure device, it is difficult to accurately measure a density variation amount caused by the inclination of the charging device. Thus, accurate adjustment of the inclination of the charging device cannot be performed.

SUMMARY OF THE INVENTION

The present invention is directed to an image forming apparatus which can detect an inclination of a charging device relative to a surface of an image carrier using a toner image output on a recording material and can prevent loss of accuracy in adjusting the inclination of the charging device caused by variation of an exposing light amount from an exposure device.

According to an aspect of the present invention, an image forming apparatus includes an image carrier, a charging device configured to charge the image carrier, an exposure device configured to form an electrostatic latent image by exposing a surface of the image carrier, a developing device configured to develop the electrostatic latent image with a toner, a controller configured to control to execute a first mode in which the surface of the image carrier charged by the charging device is exposed by the exposure device and the exposed portion is developed by the toner and a second mode in which the image carrier is developed by the toner without an exposure process by the exposure device and the developed toner image is output onto a recording material and an input device configured to input an input signal for executing the second mode, wherein the controller controls to execute the second mode under a preset image forming condition for the second mode based on the input signal from the input device.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a unit of the specification, illustrate exemplary embodiments, features, and aspects of the invention and, together with the description, serve to explain the principles of the invention.

FIG. 6 is a table illustrating an accuracy of potential adjustment using the digital image and the analog image.

DETAILED DESCRIPTION OF THE EMBODIMENTS

Various exemplary embodiments, features, and aspects of the invention will be described in detail below with reference to the drawings.

First Exemplary Embodiment

Figure 1:
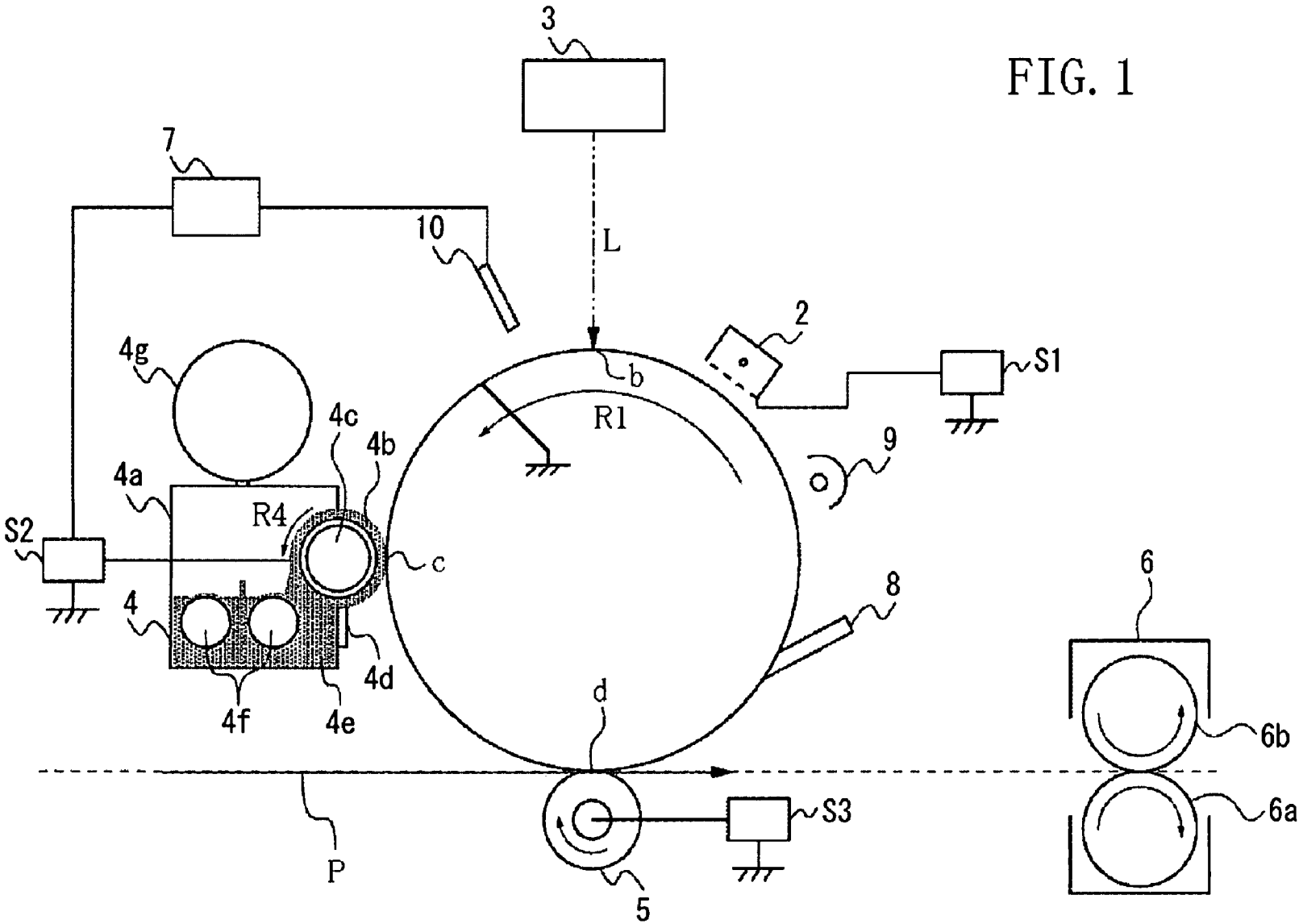
FIG. 1 is a vertical sectional view illustrating an exemplary configuration of an image forming apparatus according to a first exemplary embodiment of the present invention.

FIG. 1 illustrates a configuration example of an image forming apparatus according to a first exemplary embodiment of the present invention. The image forming apparatus is a laser beam printer (hereinafter, referred to as an "image forming apparatus") in which a maximum sheet passing size of a recording material (e.g., paper) is 19 inches long and 13 inches wide. The image forming apparatus according to the present exemplary embodiment employs an electrophotographic method, and as an exposure method, an image area exposure method for exposing an image portion where a toner image is developed. The image forming apparatus further employs a corona charging method as a charging method and a reversal developing method as a developing method.

The image forming apparatus according to the present exemplary embodiment includes a photosensitive drum (image carrier) 1 as illustrated in FIG. 1. Around the photosensitive drum 1, a corona charging device 2, an exposure device 3, a potential measuring device 10, a developing device 4, a transfer roller 5, a cleaning blade 8 and a neutralization device 9 are disposed along a rotating direction (an arrow R1 direction) of the photosensitive drum 1. Further, a fixing device 6 is disposed downstream from the transfer roller 5 along a conveyance direction of a recording material P.

The image forming apparatus according to the first exemplary embodiment includes the photosensitive drum 1 (an electrophotographic photosensitive member of a rotating drum type) serving as the image carrier. The photosensitive drum 1 includes photosensitive layers formed with organic photo semiconductors (OPCs) having negative charging characteristics. The photosensitive drum 1 has a diameter of 84 mm and is driven to rotate in the arrow R1 direction at a processing speed (circumferential speed) of 300 mm/sec around a center spindle (not shown).

Figure 2:
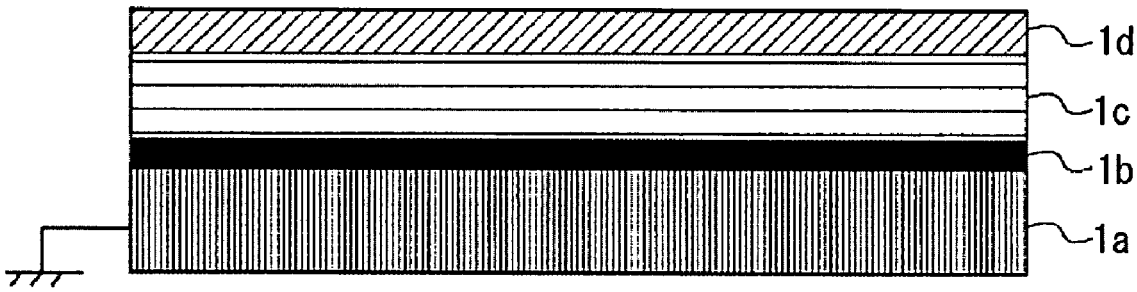
FIG. 2 is a vertical sectional view illustrating a configuration of layers of a photosensitive drum.

FIG. 2 schematically illustrates a configuration of layers of the photosensitive drum 1. The photosensitive drum 1 includes a conductive drum substrate 1*a* (conductive substrate: for example, an aluminum cylinder) at an inner side thereof (a bottom side in FIG. 2). On a surface of the conductive drum substrate 1*a*, three layers, namely an under coat layer 1*b* for improving adherence of upper layers as well as restricting interference of light, a charge generation layer 1*c*, and a charge transport layer 1*d* are sequentially applied from the inner side to the outer side of the conductive drum substrate 1*a*. The charge generation layer 1*c* and the charge transport layer 1*d* of the three layers configure a photosensitive layer.

The image forming apparatus illustrated in FIG. 1 includes the corona charging device 2. The corona charging device 2 is a scorotron type discharging device that includes a wire provided a predetermined distance away from the surface of the photosensitive drum 1, a corona discharging electrode, a conductive shield, and a grid electrode. The corona charging device 2 further includes a voltage applying device (not shown) for applying a voltage to the corona discharging electrode and a charging bias applying power source S1 for applying a voltage to the grid electrode. The corona charging device 2 performs processing for uniformly charging the surface of the photosensitive drum 1 (circumferential surface) to a predetermined polarity and potential.

A controller 7 controls an electric power supply to the corona charging device 2 so that a charging potential (dark portion potential) to be −700 V when an image is formed. In the present exemplary embodiment, the controller 7 performs a constant current control on a current value applied to the corona discharging electrode at −1000 μA, and controls a direct current (DC) applying voltage to be applied to the grid electrode to adjust the charging potential.

The image forming apparatus in FIG. 1 includes the exposure device 3 that forms an electrostatic latent image on the surface of the photosensitive drum 1 on which charging processing is performed. In the present exemplary embodiment, the exposure device 3 is a laser beam scanner using a semiconductor laser and exposes the surface of the photosensitive drum 1 at an exposing position "b" facing the exposure device 3.

The exposure device 3 outputs laser light L modulated according to an image signal that is sent to a main unit of the image forming apparatus by a host processing of an image reading device (not shown) and the like. The laser light L performs scanning exposure (image exposure) on the surface of the rotating photosensitive drum 1 on which charging processing is completed at an exposing position "b". By this scanning exposure, a potential of a portion irradiated with the laser light L on the charged surface of the photosensitive drum 1 is lowered (−300 V in the present exemplary embodiment), and then the electrostatic latent image is formed according to image information.

The developing device 4 (development unit) supplies developer (toner) to the electrostatic latent image on the photosensitive drum 1 to visualize the electrostatic latent image as a toner image. In the present exemplary embodiment, the developing device 4 is a reverse developing device of a two-component magnetic brush development type and can perform development with a different plurality of colors of toner.

The developing device 4 includes a development container 4*a*, a developing sleeve 4*b*, a magnet roller 4*c*, a developer coating blade 4*d*, a developer stirring member 4*f*, and a toner hopper 4*g*. The development container 4*a* contains two-component developer 4*e*.

The development container 4*a* stores the two-component developer 4*e* and rotatably supports the developing sleeve 4*b*. The developing sleeve 4*b* is made from a non-magnetic member having a cylindrical shape and rotatably disposed in the development container 4*a* with partially exposing an outer peripheral surface to outside. The magnet roller 4*c* is disposed inside of the developing sleeve 4*b* and is non-rotatably fixed thereto. The developer coating blade 4*d* controls a layer thickness of the two-component developer 4*e* to be coated on a surface of the developing sleeve 4*b*.

The developer stirring member 4*f* is disposed at a bottom side in the development container 4*a* to stir the two-component developer 4*e* and then conveys the two-component developer 4*e* to the developing sleeve 4*b*. The toner hopper 4*g* is a container for containing toner to be supplied into the development container 4*a*.

The two-component developer 4*e* in the development container 4*a* is a mixture of the toner and magnetic carrier and is stirred by the developer stirring member 4*f*. In the present exemplary embodiment, a resistance of the magnetic carrier is approximately $10^{13}$ Ωcm and a particle diameter is 40 μm. The toner is frictionally slid with the magnetic carrier and negatively charged by friction.

The developing sleeve 4*b* is disposed in facing relation and near to the photosensitive drum 1 in a state where the shortest gap (S-Dgap) between the developing sleeve 4*b* and the photosensitive drum 1 is kept 350 μm. A position where the photosensitive drum 1 faces the developing sleeve 4*a* is the development position "c". The developing sleeve 4*b* is driven to rotate so that the surface thereof moves in an opposite direction of a moving direction of the surface of the photosensitive drum 1 at the development position "c". In other words, the developing sleeve 4*b* is driven to rotate in an arrow R4 direction against a rotation of the photosensitive drum 1 in the arrow R1 direction.

On the outer peripheral surface of the developing sleeve 4*b*, a part of the two-component developer 4*e* in the development container 4*a* is adsorbed and retained as a magnetic brush layer by a magnetic force of the magnetic roller 4*c* disposed in the developing sleeve 4*b*. Then, the magnetic brush layer is rotationally conveyed along with a rotation of the developing sleeve 4*b*.

The magnetic brush layer is arranged to be a thin layer having predetermined thickness by the developer coating blade 4*d* and contacts the surface of the photosensitive drum 1 at the development position "c" to appropriately friction the surface of the photosensitive drum 1.

A developing bias applied to the developing sleeve 4*b* is applied by an applying power source S2 and controlled by the controller 7. A charging potential of the photosensitive drum 1 that is charged by the corona charging device 2 is detected by the potential measuring device 10. Information about a detected result is input to the controller 7. The controller 7 controls the developing bias so that the toner is developed on a non-exposed portion based on the detected result input by the potential measuring device 10 when executing an analog image output mode that will be described later.

In the above-described developing device 4, the developer in the development container 4*a* is coated on the surface of the rotating developing sleeve 4*b* as a thin layer and conveyed to the development position "c". The toner in the developer is selectively attached to a corresponding electrostatic latent image on the photosensitive drum 1 by an electric field generated by the developing bias that is applied to the developing sleeve 4*b* from the power source S2 for applying developing bias.

In the present exemplary embodiment, when forming a normal image, the DC component Vdc of the developing bias is set to −550 V and the alternate current (AC) voltage is set to 1.25 kVpp (frequency is 12 kHz at a blank pulse). Here, the blank pulse is obtained by intermittently superimposing a DC voltage onto an AC voltage.

The blank pulse is a bias that repeats a cycle including an interval in which the AC voltage and DC voltage are applied superimposing with each other (amplified part) and a subsequent interval in which only the DC voltage is applied (blank part). With this arrangement, the electrostatic latent image is developed as a toner image. In the present exemplary embodiment, the toner is attached to the exposed portion (laser light irradiated portion) on the photosensitive drum 1, and then the electrostatic latent image is reversely developed.

At this point, a charging amount of the toner that is developed on the photosensitive drum 1 is −25 μC/g.

A thin layer of the developer on the developing sleeve 4*b* that passes the development position "c" is returned into a developer storing part in the development container 4*a* along with a continuing rotation of the developing sleeve 4*b*.

In order to keep a toner density in the two-component developer 4*e* in the development container 4*a* within a predetermined substantially constant range, the toner density thereof is, for example, detected by an optical toner density sensor (not shown). Further, according to detected information, the toner hopper 4*g* is driven and controlled to supply the toner in the toner hopper 4*g* into the two-component developer 4*e* in the development container 4*a*. The toner supplied into the two-component developer 4*e* is stirred by the stirring member 4*f*.

In the present exemplary embodiment, the transfer roller 5 is used as a transfer device. The transfer roller 5 is pressed and contacted by the surface of the photosensitive drum 1 by a predetermined pressing force, and a press-contact nip part is a transfer part "d". To the transfer part "d", the recording material "P" (for example, paper, transparent film) is fed at a predetermined controlling timing from a paper feeding mechanism part (not shown).

The recording material "P" fed to the transfer part "d" is held between the rotating photosensitive drum 1 and the transfer roller 5 to be conveyed. Meantime, a transfer bias (in the present exemplary embodiment, +2 kV) having a positive polarity that is opposite to a normal negative charge of the toner, is applied to the transfer roller 5 from the transfer bias applying power source S3. With this processing, the toner images on the photosensitive drum 1 are electrostatically transferred in sequence to a surface of the recording material "P".

The recoding material "P" that passes the transfer part "d" and onto which the toner image is transferred is sequentially separated from the surface of the photosensitive drum land conveyed to the fixing device 6. Then, the recording material "P" is heated and pressed by a fixing roller 6*a* and a pressing roller 6*b*, and the toner image is fixed on the surface of the recording material "P". Finally, the recording material "P" is output as an image formed product (e.g., print or copy).

The image forming apparatus according to the present exemplary embodiment, as described later, can develop (in analog development) a toner image for adjusting a inclination of the charging device by adjusting at least one of the charging bias and the developing bias to a predetermined bias without carrying out exposure. Further, the image forming apparatus includes an analog image output mode for automatically outputting the toner image for adjustment onto the recording material. A service person can detect a density in a main scanning direction (rotational axis direction of the photosensitive drum 1) of the image (hereinafter referred to as analog image) on the recording material output by the analog image output mode.

Then, based on the detected result, the inclination of the charging device can be adjusted in the rotational axis direction of the photosensitive drum 1. Here, an inclination angle of the grid of the corona charging device 2 can be changed on a plane perpendicular to the main scanning direction of the surface of the photosensitive drum 1.

Figure 10:
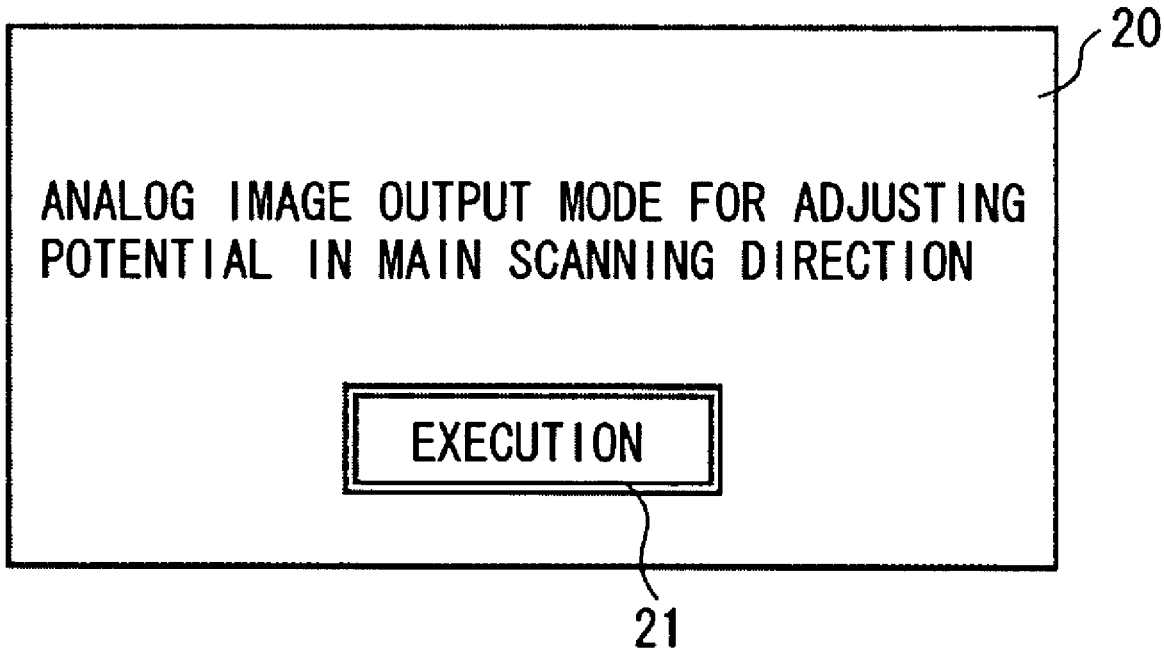
FIG. 10 is a schematic diagram illustrating an example of an execution button displayed on a touch panel for executing an analog image output mode according to the first exemplary embodiment.

The analog image can be automatically output by pressing an execution button 21 on a touch panel 20 that is provided on the main unit of the image forming apparatus, as illustrated in FIG. 10, to serve as an input device for executing the analog image output mode. An image forming condition for outputting the analog image is pre-set (pre-stored) in the controller 7 served as a storing unit. When the execution button 21 is pressed, a toner image for adjustment is automatically output.

Figure 3:
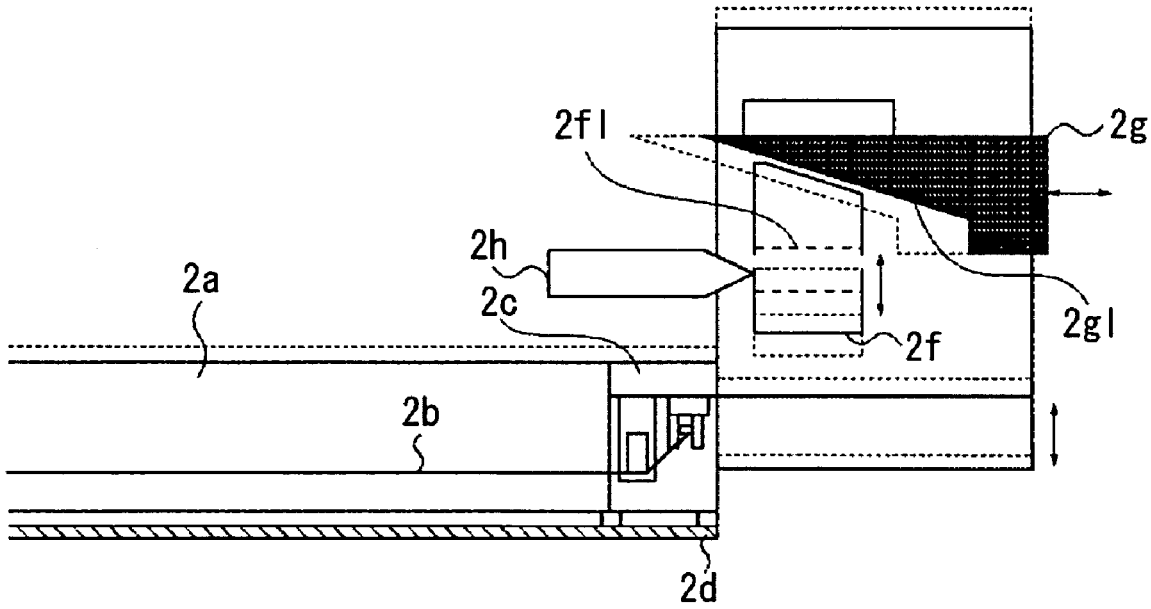
FIG. 3 is a sectional view of a major part, partly cut away, illustrating a configuration of a corona charging device 2.

FIG. 3 is a sectional view of a major part, partly cut away, illustrating a configuration of the corona charging device 2.

In FIG. 3, the corona charging device 2 is provided with a shield case 2*a* made from a conductive member such as a metal, a charge wire 2*b*, an end block 2*c* which secures a front end portion (end portion at a near side in the image forming apparatus) of the charge wire 2*b*, a grid 2*d*, a slider 2*f* which changes a gap between a front end portion of the grid 2*d* and the surface of the photosensitive drum 1, and an abutting member 2*g* in which a taper 2*g*1 is formed at a lower hem. At an upper end of the slider 2*f*, the abutting member 2*g* is provided movably in forward and backward directions (from a near side of the apparatus to a far side thereof) as illustrated by a horizontal arrow in FIG. 3.

The abutting member 2*g* is moved by a screw (not shown). By moving the abutting member 2*g* forward and backward, the slider 2*f* relatively moves along the taper 2*g*1 and moves upward and downward. A position determining member 2*h* is provided for the corona charging device 2 disposed in the main unit of the image forming apparatus. Inserting the position determining member 2*h* into a position determining hole 2*f*1 in the slider 2*f* determines the gap between the front end portion of the grid 2*d* and the surface of the potential measuring device 10. The abutting member 2*g*, the slider 2*f*, and the position determining member 2*h* configure an adjusting device for adjusting the gap between the grid 2*d* of the corona charging device 2 and the surface of the photosensitive drum 1.

At a rear end portion of the grid 2*d* (not shown), the slider 2*f* for changing a gap between the rear end portion thereof and the surface of the photosensitive drum 1 is not provided, but the gap therebetween is fixed.

The shield case 2*a* is provided with an opening portion facing the photosensitive drum 1, substantially in parallel to the axis of the photosensitive drum 1 at a predetermined interval. Moving the slider 2*f* upward and downward makes the front end portion of the grid 2*d* closer to or away from the photosensitive drum 1 so as to change the inclination angle of the grid 2*d* on the perpendicular plane to the rotational axis direction of the surface of the photosensitive drum 1.

As well known, when the grid 2*d* comes closer to the photosensitive drum 1, the charging potential on the photosensitive drum 1 is raised. Therefore, if the inclination angle of the grid 2*d* is changed, the charging potential of the photosensitive drum 1 inclines toward the axis direction. Thus, a non-uniform density of the analog image is corrected in the main scanning direction, so that the potential of the photosensitive drum 1 at the development position in the main scanning direction becomes uniform.

Here, density correction of the analog image in the main scanning direction will be described.

Figure 4:
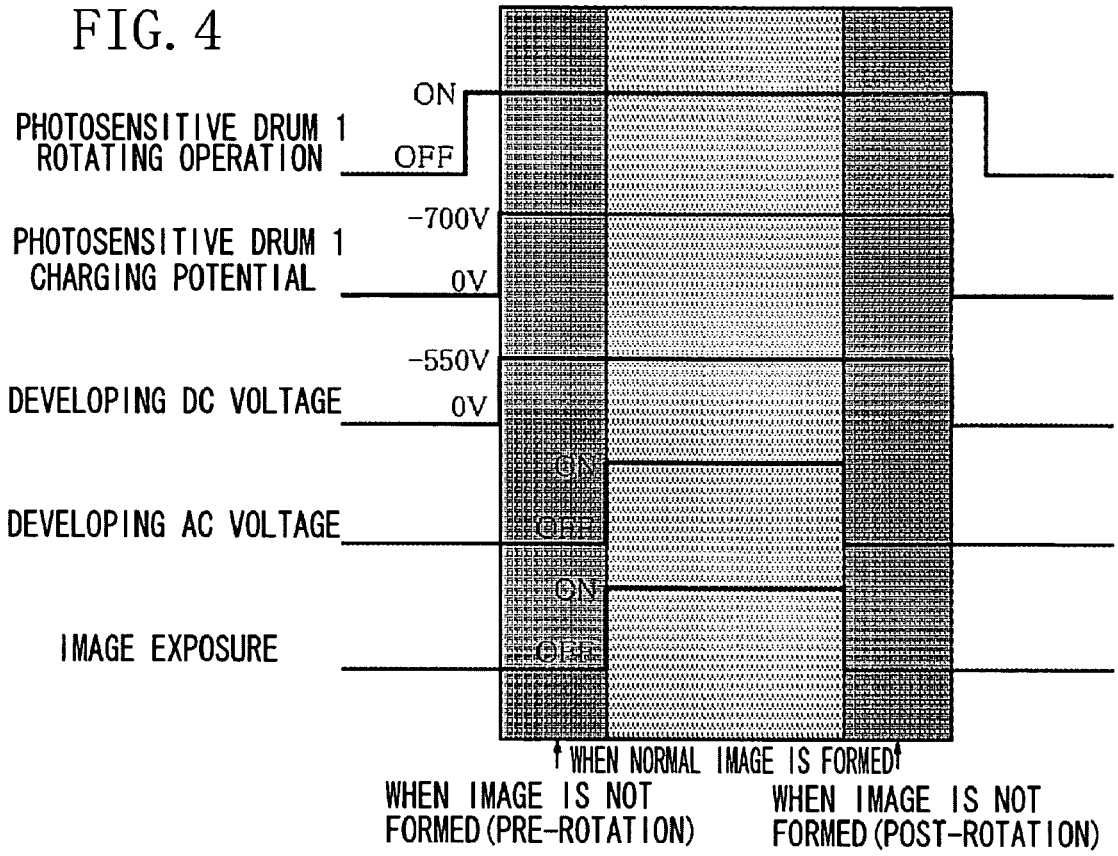
FIG. 4 illustrates absolute values and timings of applying voltages when a normal image and an analog image are formed.
Figure 4:
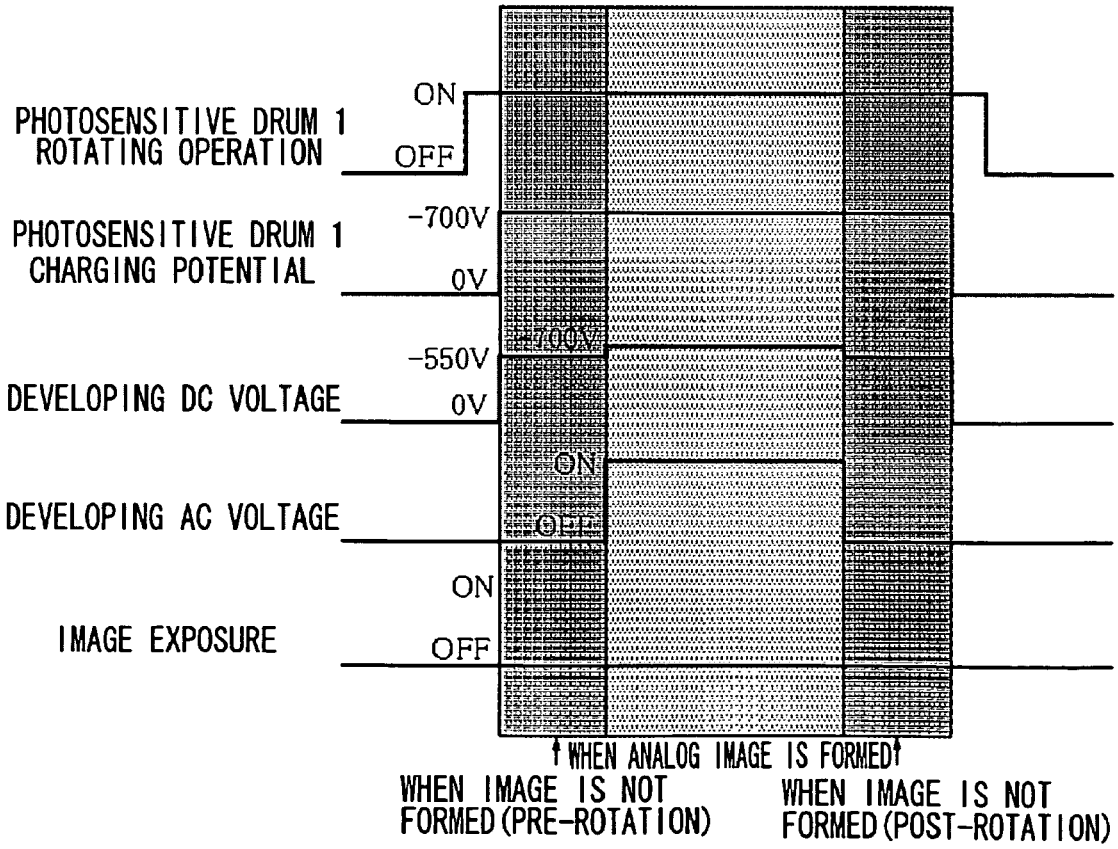

FIG. 4 illustrates absolute values and timings of applying voltages when forming a normal image (the first mode) and forming an analog image (the second mode), in the present exemplary embodiment. Forming the normal image described in the present exemplary embodiment means to form an electrostatic latent image by exposing a charging surface of the photosensitive drum 1 with the exposure device according to an image forming signal and then form an image by developing the electrostatic latent image with the toner.

Further, in the analog image forming, a toner image is developed at the charging potential without exposure by the exposure device. In the analog image according to the present exemplary embodiment, by reducing a difference between a charging potential VD and the DC component Vdc of the developing bias of the photosensitive drum 1, compared to when forming the normal image, the toner image for adjustment can be developed at a region where the image should not originally developed. (So called fogging is forcibly generated.) Further, the analog image can also be formed when an absolute value of the DC component of the developing bias is set larger than the charging potential.

When forming the normal image, the charging potential VD is set to −700 V and the DC component Vdc of the developing bias is set to −550 V. When the analog image is formed, the DC component Vdc of the developing bias is changed to −700 V. The charging potential VD of the photosensitive drum 1 described here is a value measured by the potential measuring device 10 located at a center with respect to the main scanning direction of the photosensitive drum 1. Further, the DC component Vdc of the developing bias is set for the charging potential VD of the photosensitive drum 1 at a position of the potential measuring device 10. In order to increase an accuracy of height adjustment of the charging device, it is desired that a density change of the output image is large relative to a variation of the potential difference Vcont between the drum charging potential VD and the DC component of the developing bias. Therefore, as the potential difference Vcont to be set in an adjustment mode, a value of a largest slope of density characteristics to the potential difference Vcont in FIG. 5 can be used.

Figure 5:
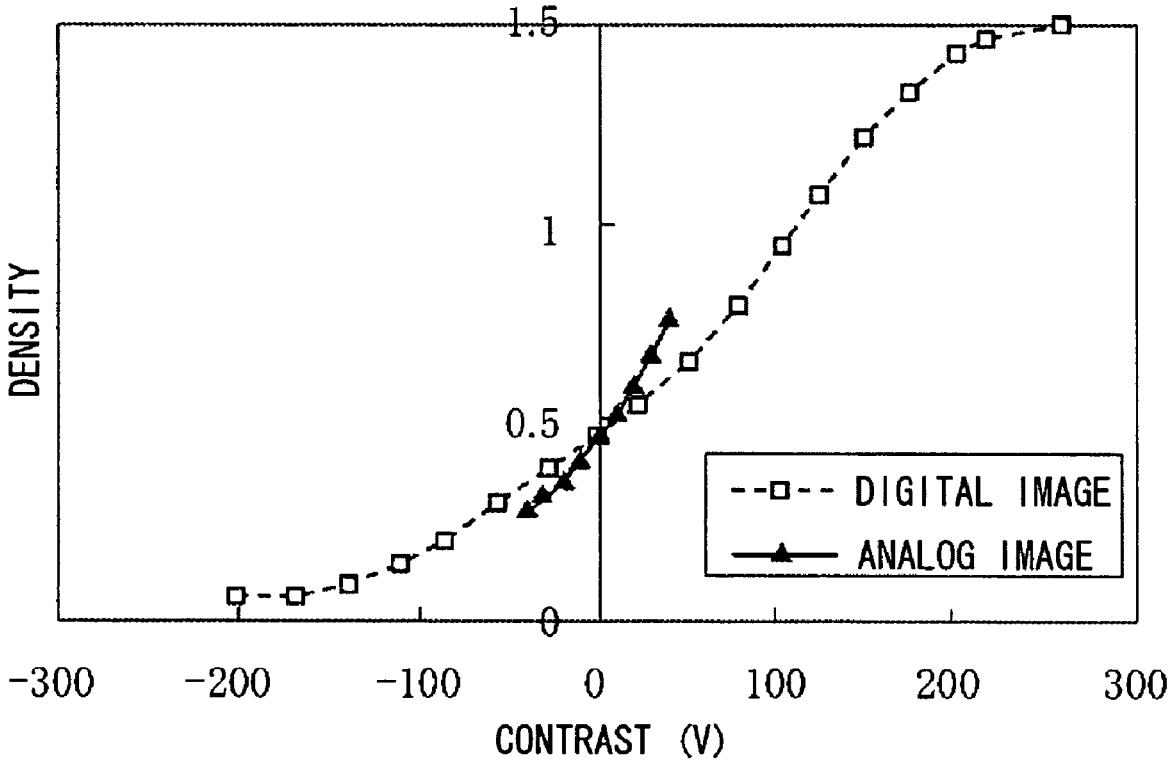
FIG. 5 is a graph illustrating a relationship between a contrast and a density of a digital image and an analog image.

Merit for using an analog image (non-exposed image) as an image for adjusting the height of the charging device will be described, compared with using a digital image. FIG. 5 illustrates relationships between the variation of the image density and the variation of the potential difference Vcont between the DC component of the developing bias and the potential on the drum surface where the toner is developed and in which a case of forming the normal image and a case of forming the analog image are compared.

FIG. 5 illustrates that the variation of density to the change of contrast in the analog image is larger than in the normal image (digital image). That is, a potential difference is likely to appear as a density difference in the analog image. Even when the contrast between the digital image and the analog image is macroscopically equal, a micro potential profile of the latent image generated by exposure in the digital method is different from the analog latent image without exposure. Due to the difference of the profiles, developing characteristics of the latent images vary and appear as the density difference.

A lateral axis in FIG. 5 illustrates a changing amount of the contrast of the macro potential described above and a slope of the digital image is different from the analog image. The changing amount of the density to the change of the contrast is in the analog image larger than the digital image due to a phenomenon described above. Accordingly, a potential of non-exposed portion on the photosensitive drum 1 at the development position in the main scanning direction can be more accurately uniformed when the inclination of the charging device is adjusted by detecting the analog image than by using the digital image.

In the present exemplary embodiment, analog images are output to have a density 0.5 by measurement of an X-Rite reflective densitometer at the position of the potential measuring device 10 which is located at the center in the main scanning direction of the photosensitive drum 1. The inclination angle of the grid 2*d* is adjusted so that the density difference between the front end portion and the rear end portion of the images in the main scanning direction of the both images is 0.02 or less.

FIG. 6 illustrates the potential difference of the non-exposed portions at the development position between the front end portion and the rear end portion, when the inclination adjustment of the charging device is performed using the analog image according to the present exemplary embodiment. A comparison example illustrates the potential difference between the front end portion and the rear end portion of the non-exposed portion at the development position when the inclination adjustment of the charging device is performed using the digital image as a toner image.

The comparison example illustrates a result of the above adjustment performed using each digital image which is formed by changing a light amount difference of an optical system in the main scanning direction. In the digital image, the potential difference of the front end portion and the rear end portion of the non-exposed portions at the development position is increased according to the light amount difference (light amount variation) and causes nonuniformity. On the other hand, on the analog image, the potential difference can be uniformed at less than 10V.

That is, according to the present exemplary embodiment, since the analog image is not affected by the exposure variation generated by the exposure device, the charging potential can be uniformed in the main scanning direction. Further, since the density change with respect to the inclination of the charging device in the analog image is larger than in the digital image, the inclination of the charging device can be more accurately adjusted using the analog image.

Figure 11:
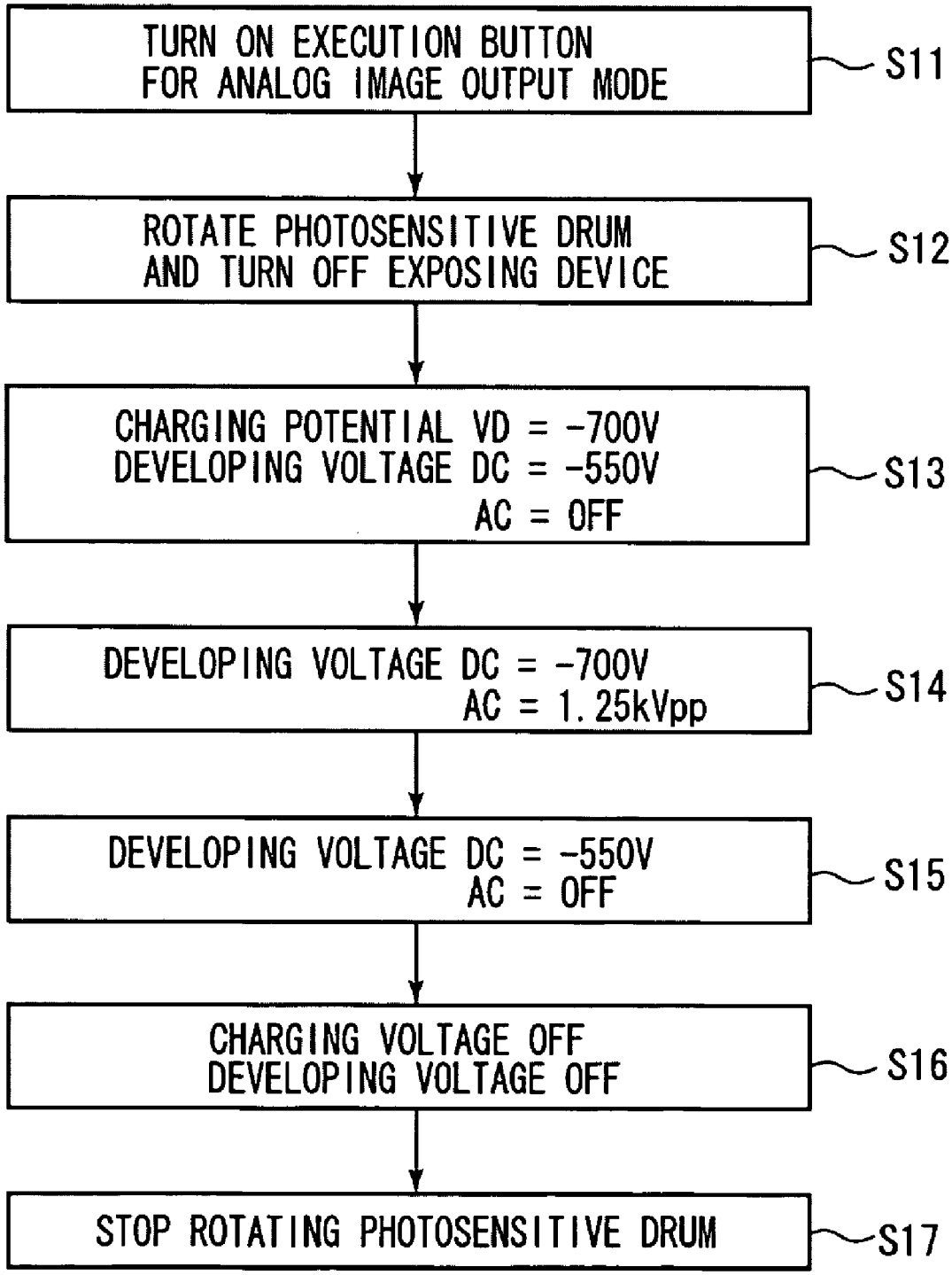
FIG. 11 is a flowchart of an analog image output mode according to the first exemplary embodiment.

FIG. 11 is a flowchart illustrating an analog image output mode according to the present exemplary embodiment. When an operator presses the execution button 21 for executing the analog image output mode in step S11, the controller 7 causes the photosensitive drum 1 to rotate in a state that the exposure device 3 is turned off in step S12. The controller 7 applies a preset charging bias to the photosensitive drum 1 so that the charging potential thereof becomes −700 V and applies the developing bias (DC voltage=−550 V, AC voltage OFF) to the developing sleeve 4*b* to execute a pre-rotation in step S13.

In the present exemplary embodiment, the controller 7 performs the constant current control on the corona discharging electrode at −1000 μA and controls a DC voltage applied to the grid 2*d* to be set at a predetermined charging potential.

The controller 7 changes the developing bias to be applied to the developing sleeve 4*b* to DC=−700 V and AC=1.25 kVpp at a predetermined timing in step S14, and then a toner image for adjustment is developed to be an analog image. The developed analog image is transferred to the recording material that is conveyed and output as the analog image. In the present exemplary embodiment, the toner image can be developed on the non-exposed portion by reducing the deference between the charging potential and the DC component of the developing bias of the photosensitive drum 1 compared to a case of forming the normal image as described above.

When development of the predetermined toner image for adjustment is completed, the controller 7 returns the developing bias to DC voltage=−550 V and AC voltage OFF to execute a post-rotation in step S15. The controller 7 turns off the charging voltage and the developing voltage in step S16 and stops the rotation of the photosensitive drum 1 in step S17.

As described above, since the image forming apparatus according to the present invention has the mode in which the toner image for the inclination adjustment on the charging device is automatically output, the analog image for adjustment can be easily output without troublesome settings.

In the present invention, the analog image is developed with toner on the non-exposed portion by differentiating the developing DC voltage from that of the normal image when the exposure device is turned off. However, the present invention is not limited the above described configuration. That is, in place of the developing DC voltage, the charging potential can be changed when the exposure device is turned off. Alternatively, both of the developing DC voltage and the charging potential can be adjusted. When changing the charging potential, the charging potential can be set by adjusting at least one of the voltages applied to the charging bias applying power S1 and to the device for applying a voltage to the corona discharging electrode.

Further, in the present exemplary embodiment, when forming the analog image, the difference between the charging potential (the DC component of the charging bias) and the DC component of the developing bias of the photosensitive drum 1 is reduced. However, as long as allows the toner image can be developed on the non-exposed portion, the present invention is not limited the above described configuration. For example, the absolute value of the DC component of the developing bias can be set larger than the charging potential or the DC component of the charging bias.

Second Exemplary Embodiment

Figure 7:
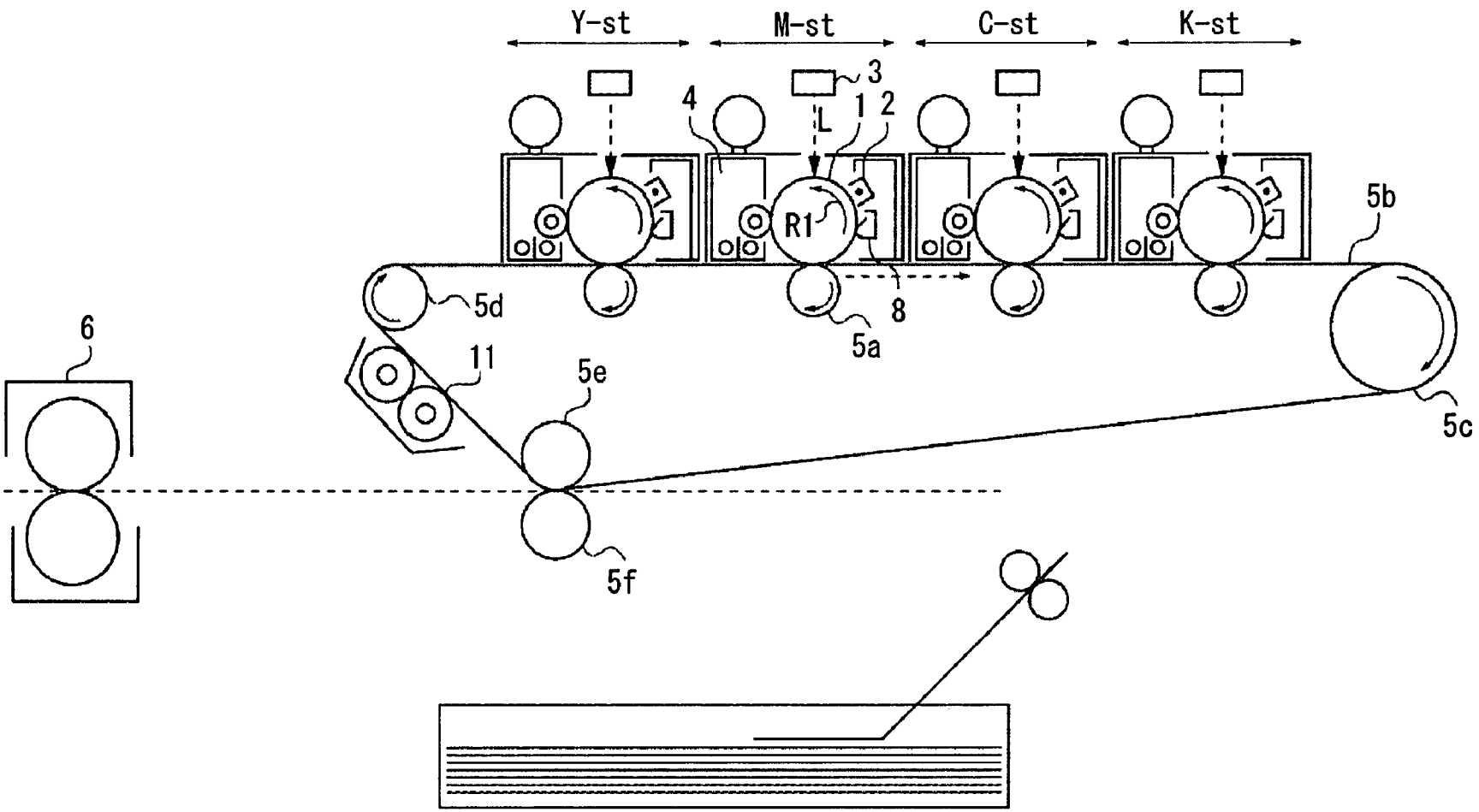
FIG. 7 illustrates an exemplary configuration of an image forming apparatus according to a second exemplary embodiment of the present invention.

FIG. 7 illustrates a configuration of an image forming apparatus according to a second exemplary embodiment of the present invention.

The image forming apparatus (printer) according to the second exemplary embodiment, unless otherwise described, has the same configuration as the first exemplary embodiment. That is, the image forming apparatus includes an image forming unit including a photosensitive drum 1. Further, in a rotating direction (an arrow R1 direction) of the photosensitive drum 1, the image forming unit includes in order a corona charging device 2, an exposure device 3, a developing device 4, a transfer device 5, a potential measuring device (not shown) and a neutralization device (not shown). The second exemplary embodiment differs from the first exemplary embodiment in that the image forming apparatus includes a plurality of the image forming units (four units) in tandem. The image forming units Y-st, M-st, C-st, K-st respectively form toner images in yellow, magenta, cyan, and black.

Unlike the first exemplary embodiment, the transfer device 5 employs an intermediate transfer method in the present exemplary embodiment. An intermediate transfer belt 5*b* is made from resin such as polyethylene terephthalate and polyimide which dispersedly include carbon to adjust a resistance. A driving roller 5*c* drives the intermediate transfer belt 5*b* to rotate. The driving roller 5*c* rotates to make the intermediate transfer belt 5*b* proceed in the same direction as a proceeding direction of the photosensitive drum 1. A tension roller 5*d* is adjusted to maintain a constant tension of the intermediate transfer belt 5*b* between the driving roller 5*c* and an opposing roller 5*e*.

A first transfer roller 5*a* is disposed opposing to the photosensitive drum 1 of each image forming device via the intermediate transfer belt 5*b*. A second transfer roller 5*f* simultaneously transfers toner images formed on the intermediate transfer belt 5*b* to a transfer material. An intermediate transfer belt cleaner 11 prevents the intermediate transfer belt 5*b* from being contaminated with the toner or paper particles.

In the image forming apparatus employing the intermediate transfer method, a toner image formed by each image forming unit is transferred on the intermediate transfer belt 5*b* in order of yellow, magenta, cyan, and black. The secondary transfer roller 5*f* collectively transfers the toner images of overlapped four colors onto a transfer material which is fed to the secondary transfer roller 5*f* by a feeding device. Subsequently, the toner images on the transfer material are fixed by a fixing device 6.

The image forming apparatus according to the present exemplary embodiment includes a mode (hereinafter referred to as a four-colored analog image output mode) in which the analog image described in the first exemplary embodiment is formed on one printed image without overlapping with other analog images of different colors and fixed on the transfer material having a size of 19 inches long and 13 inches wide.

As an input device for executing the four-colored analog image output mode, the image forming apparatus includes a touch panel 20 shown in FIG. 10 and a controller 7. When an execution button 21 on the touch panel 20 is pressed as illustrated in FIG. 10, the four-colored analog image can be automatically output.

Figure 8:
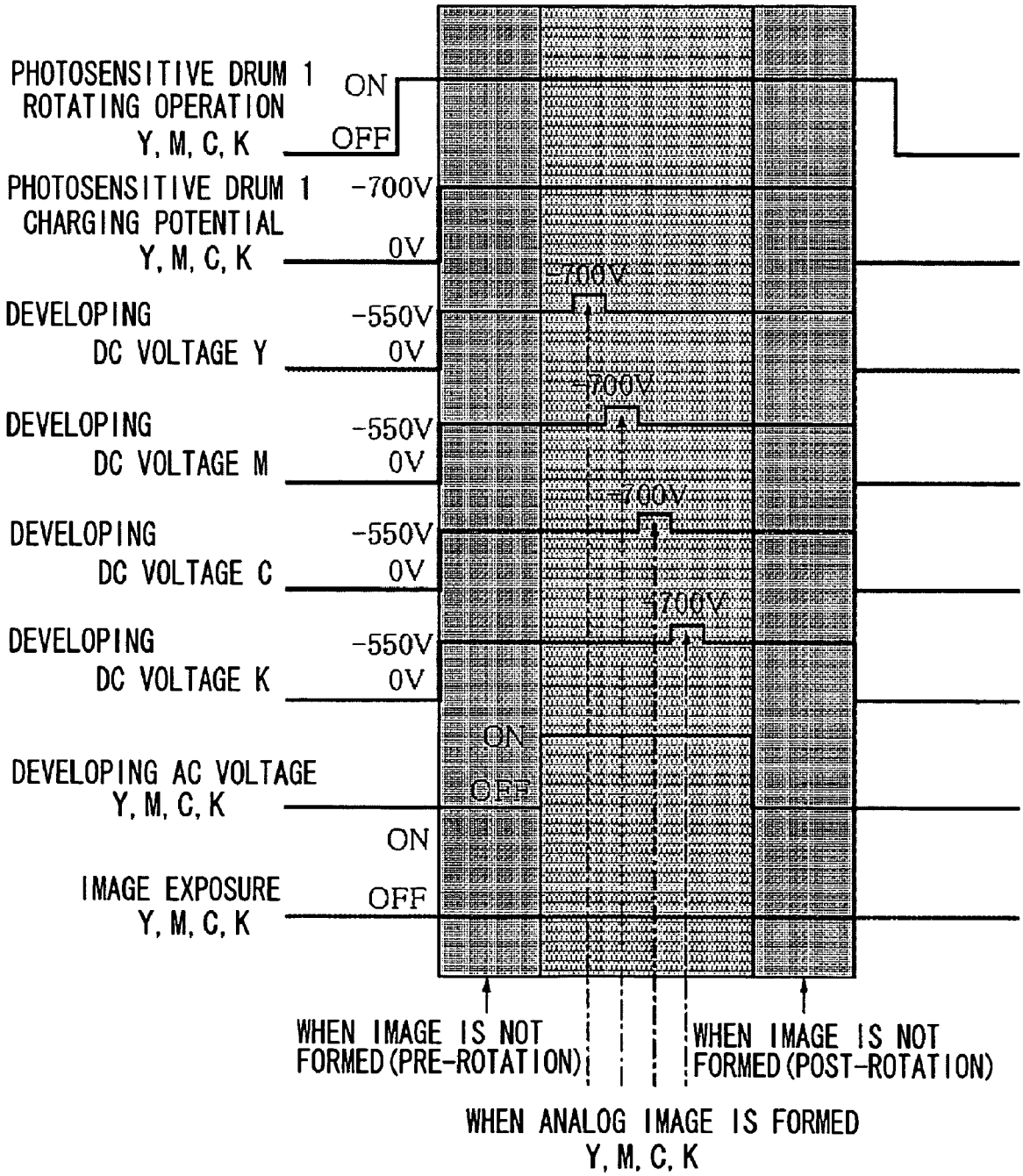
FIG. 8 illustrates absolute values and timings of applying voltages in a four-colored analog image output mode according to the second exemplary embodiment.

FIG. 8 illustrates absolute values and timings of applying voltages in the four-colored analog image output mode. An applying time of a DC component (here, it is −700 V) of the developing bias for forming the analog image is set to 250 msec for each color, and applying timing of each color is shifted from one another. With this arrangement, as illustrated in FIG. 9, the analog images of four colors having 75 mm wide in a sub scanning direction are respectively formed on each one print in sequence from a yellow station located upstream.

Figure 9:
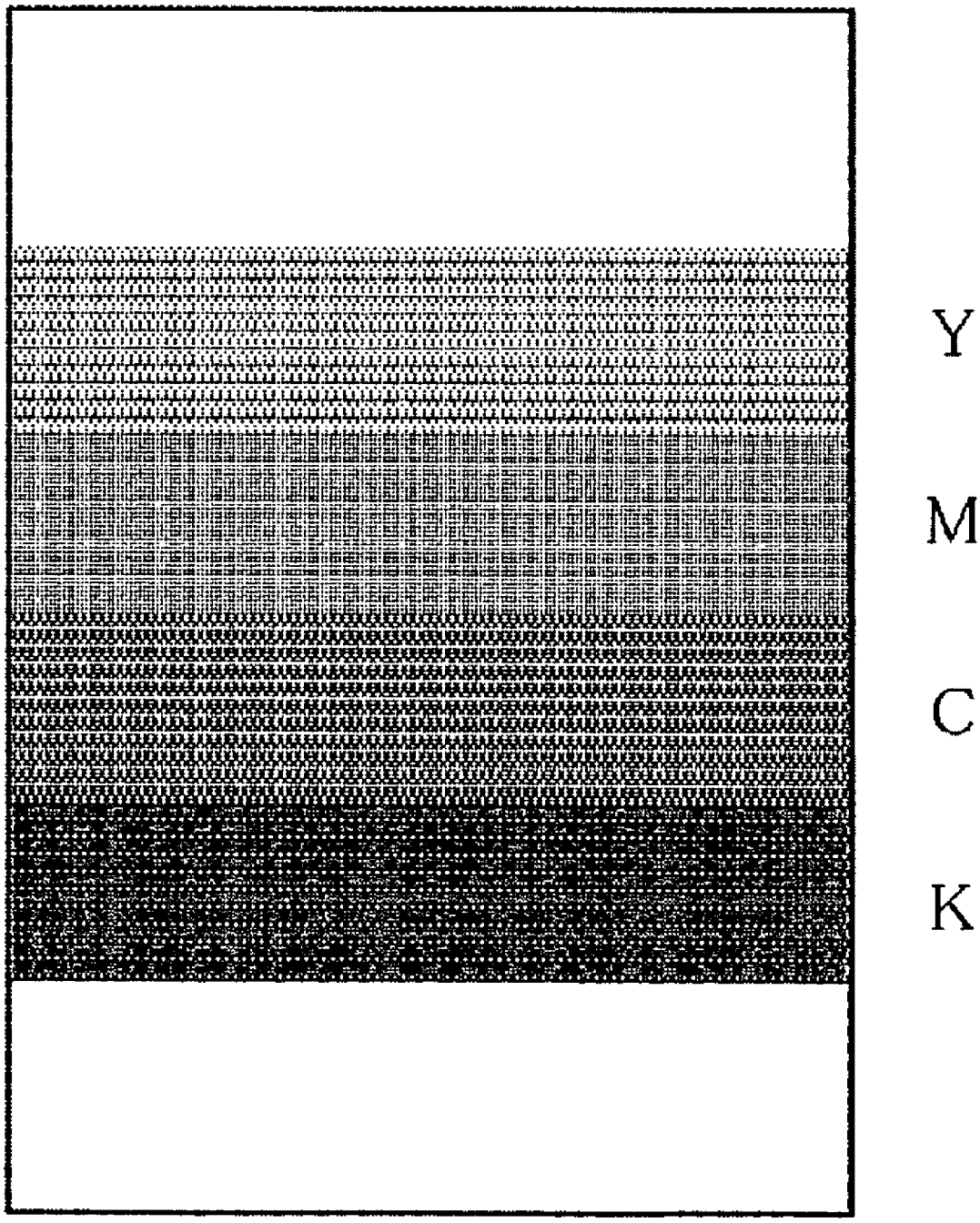
FIG. 9 illustrates a state where respective four color analog images are formed on one print image according to the second exemplary embodiment.

As illustrated in FIG. 9, an analog image is formed on each one print without overlapping with other analog images of different colors. With this processing, it is possible to simultaneously measure the density difference between the front end portion and the rear end portion of each color in the main scanning direction on one printed image and simultaneously adjust the inclination angle of the grid 2*d* for each color. Therefore, a number of printings for adjustment can be reduced and the analog image of each color can be output in a short time.

Normally, the above described analog image is different from the digital image in that an image region in the main scanning direction corresponds to a width of a coating region of the two-component developer 4*e* that is adsorbed and retained on the outer peripheral surface of the developing sleeve 4*b*. Accordingly, if the image is transferred to a transfer material having a width narrower than the coating region of the image, the toner at end portions is not transferred to the transfer material but remains on the intermediate transfer belt 5*b*.

The remaining toner contaminates the end portions of the second transfer roller 5*f* and the intermediate transfer belt cleaner 11, so that subsequent images are ill-formed due to contamination on the back of the transfer material and the like. The digital image in the present exemplary embodiment refers to the image that reproduces the contrasting density by modulating an area exposed by the exposure device.

In the present exemplary embodiment, a width of the coating region of the two-component developer 4*e* that is adsorbed and retained on the outer peripheral surface of the developing sleeve 4*b* is set to 328 mm. When a transfer material of 13 inches (330.2 mm) wide that is larger than 328 mm is used, the ill-formed image can be prevented. That is, in the mode for outputting the analog image for adjustment, the controller 7 automatically selects and outputs a paper having a width larger than the coating area of the developing sleeve 4*b* in the width direction orthogonal to the conveyance direction of the recording material to be output.

Further, at the timing when the four-colored analog image output mode is set, the transfer material having a width larger than the coating region of the two-component developer 4*e* that is adsorbed and retained on the outer peripheral surface of the developing sleeve 4*b* is automatically selected and occurrence of the ill-formed image caused by mistakes of selection of the transfer material can be restricted.

In the present exemplary embodiment, as the four-colored analog image output mode, different Y, M, C, K colors are described as an example. However, the present invention is not limited to these four colors, and when spot colors of the toner such as dark and light are used, the image forming unit can be configured to output the analog image formed with the dark and light toner. Further, in the present exemplary embodiment, the corona charging method is described as an example of the charging device, but the present invention is not limited this charging method. For example, the image forming apparatus according to the present exemplary embodiment can be applied to a charging roller of a non-contact type. Further, in the present exemplary embodiment, the distance from the grid (the inclination of the grid) relative to the surface of the image carrier in the rotational axis direction of the image carrier is adjusted, so as to adjust the inclination of the charging device relative to the surface of the image carrier. However, the invention is not limited to the adjustment of the distance from the grid. For instance, the distance between a surface of a drum and a charge wire in a main scanning direction may be adjusted.

According to the present invention, the image forming apparatus which adjusts the inclination of the charging device using the toner image output onto the recording material can execute the accurate adjustment of the inclination of the charging device, even though there are variations of the exposing light amount emitted from the exposure device.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-167460 filed Jun. 26, 2007, which is hereby incorporated by reference herein in its entirety.

What is claimed is:

1. An image forming apparatus comprising:

an image carrier;

a charging device configured to charge the image carrier;

an exposure device configured to form an electrostatic latent image by exposing a surface of the image carrier;

a developing device configured to develop the electrostatic latent image with a toner;

a controller configured to control to execute a first mode in which the surface of the image carrier charged by the charging device is exposed by the exposure device and the exposed portion is developed by the toner and a second mode in which the image carrier charged by the charging device is developed by the toner without an exposure process by the exposure device and the developed toner image is output onto a recording material; and an input device configured to input an input signal for executing the second mode, wherein the controller controls to execute the second mode under a preset image forming condition for the second mode based on the input signal from the input device, wherein, in the first mode, an absolute value of a dark portion potential of the image carrier charged by the charging device is larger than an absolute value of a DC voltage applied to the developing device and, in the second mode, the absolute value of the DC voltage applied to the developing device is larger than or equal to the absolute value of the charging potential.

2. The image forming apparatus according to claim 1, wherein the developing device is capable of developing with toner of a plurality of different colors, and wherein, in the second mode, toner images of each color can be formed on a same recording material at different positions.

3. The image forming apparatus according to claim 1, further comprising an adjusting device configured to adjust an inclination of the charging device relative to a surface of the image carrier, wherein the toner image output in the second mode is an adjustment toner image for adjusting the inclination of the charging device by the adjusting device.

4. The image forming apparatus according to claim 1, wherein an image corresponding to an input image signal is output to a sheet in the first mode, and an image for adjusting the apparatus is output to a sheet in the second mode.

5. An image forming apparatus comprising:

an image carrier;

a charging device configured to charge the image carrier;

an exposure device configured to form an electrostatic latent image by exposing a surface of the image carrier;

a developing device configured to develop the electrostatic latent image with a toner;

a controller configured to control to execute a first mode in which the surface of the image carrier charged by the charging device is exposed by the exposure device and the exposed portion is developed by the toner and a second mode in which the image carrier charged by the charging device is developed by the toner without an exposure process by the exposure device and the developed toner image is output onto a recording material; and an input device configured to input an input signal for executing the second mode, wherein the controller controls to execute the second mode under a preset image forming condition for the second mode based on the input signal from the input device, wherein, in the first mode, an absolute value of a DC voltage applied to a charging bias is larger than an absolute value of a DC voltage applied to a developing bias and, in the second mode, the absolute value of the DC voltage applied to the developing bias is larger than or equal to the absolute value of the DC voltage applied to the charging potential.

6. An image forming apparatus comprising:

an image carrier;

a charging device configured to charge the image carrier;

an exposure device configured to form an electrostatic latent image by exposing a surface of the image carrier;

a developing device configured to develop the electrostatic latent image with a toner;

a controller configured to control to execute a first mode in which the surface of the image carrier charged by the charging device is exposed by the exposure device and the exposed portion is developed by the toner and a second mode in which the image carrier charged by the charging device is developed by the toner without an exposure process by the exposure device and the developed toner image is output onto a recording material; and an input device configured to input an input signal for executing the second mode, wherein the controller controls to execute the second mode under a preset image forming condition for the second mode based on the input signal from the input device, wherein the developing device comprises a developing sleeve configured to carry the toner on an outer peripheral surface thereof to develop the toner image on the image carrier, and wherein, in the second mode, the controller selects the recording material having a larger size in a width direction on which an image is formed than a width of a coating region of the developing sleeve on which the toner is coated with respect to a rotational axis of the image carrier.

7. The image forming apparatus according to claim 6, wherein an image corresponding to an input image signal is output to a sheet in the first mode, and an image for adjusting the apparatus is output to a sheet in the second mode.

* * * * *